US010692673B2

(12) United States Patent
Ledru et al.

(10) Patent No.: US 10,692,673 B2
(45) Date of Patent: Jun. 23, 2020

(54) ELECTRIC ARC-BLAST NOZZLE AND A CIRCUIT BREAKER INCLUDING SUCH A NOZZLE

(71) Applicant: GENERAL ELECTRIC TECHNOLOGY GMBH, Baden (CH)

(72) Inventors: Roger Ledru, Tignieu (FR); Daniel Vigouroux, Auvergne-Rhone-Alpes (FR)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 0 days.

(21) Appl. No.: 16/312,622

(22) PCT Filed: Jun. 21, 2017

(86) PCT No.: PCT/EP2017/065130
§ 371 (c)(1),
(2) Date: Dec. 21, 2018

(87) PCT Pub. No.: WO2018/001798
PCT Pub. Date: Jan. 4, 2018

(65) Prior Publication Data

US 2019/0214207 A1 Jul. 11, 2019

(30) Foreign Application Priority Data

Jun. 29, 2016 (FR) ..... 16 56086

(51) Int. Cl.
*H01H 33/70* (2006.01)
*H01H 33/91* (2006.01)

(52) U.S. Cl.
CPC ..... *H01H 33/703* (2013.01); *H01H 33/7023* (2013.01); *H01H 33/7069* (2013.01); *H01H 33/7076* (2013.01); *H01H 33/91* (2013.01)

(58) Field of Classification Search
CPC ..... H01H 33/7023; H01H 33/703; H01H 33/7069; H01H 33/7076; H01H 33/765
(Continued)

(56) References Cited

U.S. PATENT DOCUMENTS 4,562,322 A * 12/1985 Yamaguchi ..... H01H 33/021 174/110 N
5,925,863 A * 7/1999 Zehnder ..... H01H 33/7023 218/53

(Continued)

FOREIGN PATENT DOCUMENTS

| | | | |
|---|---|---|---|
| DE | 4111932 | A1 | 10/1992 |
| DE | 102006031217 | A1 | 1/2008 |
| WO | 2015039918 | A1 | 3/2015 |

OTHER PUBLICATIONS

French Search Report and Written Opinion dated Jan. 4, 2017 which was issued in connection with FR1656086 which was filed on Jun. 29, 2016.

(Continued)

*Primary Examiner* — William A Bolton
(74) *Attorney, Agent, or Firm* — Eversheds Sutherland (US) LLP

(57) ABSTRACT

A nozzle with an electric arc-blast having a median part of a first dielectric material and two end parts. The nozzle includes an insert of a second dielectric material, chosen from among:

a composite material including a fluorocarbon polymer matrix and inorganic filler A chosen from among a sulfur, a ceramic and an oxide (SiO2, TiO2, Al2CoO4, ZnO, BaTiO3 and P2O5), in a percentage weight ranging between 0.1% and 10%, and/or at least one inorganic filler B (a graphite, a mica, a glass and a fluoride), in a percentage weight ranging between 5% and 50%, and (Continued)

a ceramic material including compound(s) (a carbide, a boride and an oxide).

20 Claims, 4 Drawing Sheets

(58) Field of Classification Search
USPC ..... 218/62, 53, 54, 63, 64, 72
See application file for complete search history.

(56) References Cited

U.S. PATENT DOCUMENTS 6,040,970 A * 3/2000 Lehmann ..... H01H 33/7061 218/53
6,049,050 A * 4/2000 David ..... H01H 3/36 218/154
6,744,000 B1 * 6/2004 Bergmann ..... H01H 33/24 218/43
8,129,647 B2 * 3/2012 Haberer ..... H01H 33/7069 218/53
8,633,413 B2 * 1/2014 Cernat ..... H01H 33/703 218/59

OTHER PUBLICATIONS

International Search Report and Written Opinion dated Sep. 28, 2017 which was issued in connection with PCTPCT/EP2017/065130 which was filed on Jun. 21, 2017.

* cited by examiner

ELECTRIC ARC-BLAST NOZZLE AND A CIRCUIT BREAKER INCLUDING SUCH A NOZZLE

TECHNICAL FIELD

The present invention relates to an electric arc-blast nozzle intended to be included in a high voltage circuit breaker, this voltage typically ranging between 52 kV and 800 kV.

The invention also relates to a high voltage circuit breaker including such an electric arc-blast nozzle.

BACKGROUND OF THE DISCLOSURE

An electric arc-blast circuit breaker has at least two arc contacts axially mobile in relation to each other, between a circuit breaker opening position in which the arc contacts are separated from each other and a circuit breaker closing position in which the arc contacts are in contact with each other, an electric arc-blast nozzle and an electric arc cut-off gas circulating in the nozzle to cut an electric arc that is likely to be formed during the movement of the arc contacts from the closing position to the opening position of the circuit breaker.

A conventional electric arc-blast nozzle consists of the following parts:

i. a median neck-forming part internally defining an axial electric arc cut-off passage and formed by a dielectric material obtained from a composition consisting of a fluorocarbon polymer matrix, and ii. two end parts extending on either side of the median part which are respectively intended to receive the arc contacts that can be axially moved in relation to each other, between a circuit breaker opening position in which the arc contacts are separated from each other and a circuit breaker closing position in which the arc contacts are in contact with each other and in which one of the arc contacts partially closes the axial passage of the median part, an electric arc cut-off gas circulating in the axial passage of the median part to cut an electric arc that is likely to be formed during the movement of the arc contacts from the closing position to the opening position of the circuit breaker.

The dielectric material of the median part of the nozzle is classically obtained from a composition consisting of a fluorocarbon polymer matrix, such as polytetrafluoroethylene (PTFE).

To cut an electric arc, an arc-blast circuit breaker uses a cut-off gas formed by an insulating dielectric gas. This cut-off gas is delivered from a blast chamber in the axial passage of the median part of an electric arc-blast nozzle as described above. The function of such a nozzle is to channel the electric arc and, in doing so, increase the pressure of the cut-off gas around the electric arc, thus encouraging its cut-off.

Currently, the cut-off gas most commonly used in this type of circuit breakers is sulfur hexafluoride $SF_6$ and this, because of its exceptional physical properties. However, $SF_6$ has the major disadvantage of being a very powerful greenhouse gas, with a particularly high global warning potential (GWP).

Among the alternatives to using $SF_6$ as cut-off gas, there are various known gases with lower global warning potential (GWP) than that of $SF_6$, such as dry air or even nitrogen.

Carbon dioxide $CO_2$ is a particularly interesting cut-off gas due to its strong electric insulation and electric arc extinguishing ability. Furthermore, $CO_2$ is nontoxic, non-inflammable, has a very low GWP and, in addition, is easy to procure.

$CO_2$ can be used by itself or in the form of a gaseous mix, constituted mainly of the predominant gas known as "vector gas".

Since the density of $CO_2$ is lower than that of $SF_6$ and the speed of sound in $CO_2$ is greater than that in $SF_6$, it is observed that the blasting pressure of the electric arc decreases earlier and more quickly with $CO_2$ than with $SF_6$ as the cut-off gas.

Due to this relatively quicker decline in the blasting pressure of the electric arc with $CO_2$, short-circuiting with $CO_2$ is more difficult to achieve than with $SF_6$, specially on long electric arcing times. Under these conditions, the blasting pressure of $CO_2$ may not be sufficient to enable the electric arc cut-off.

In order to overcome this drawback and allow effective electric arc cut-off, the blasting pressure of the electric arc must necessarily be higher when using $CO_2$, instead of $SF_6$, as the cut-off gas.

Multiple solutions were proposed to increase this electric arc-blasting pressure, and thus avoid loss of pressure on long arcing times.

A first solution consists of offering a circuit breaker working with $CO_2$ equipped with a larger swabbing volume than a circuit breaker working with $SF_6$. Thus, such a circuit breaker working with $CO_2$ has an enlarged section of the piston, which requires an increase in the control energy in order to obtain adequate blasting pressure for cutting the electric arc.

The drawback of this first solution resides in the fact that such a circuit breaker has, by construction, larger dimensions than a conventional circuit breaker working with $SF_6$, thus making the circuit breaker working with $CO_2$ more expensive than the one working with $SF_6$.

A second solution consists of using electric arc energy to increase thermal effect, and thus the pressure in the blasting chamber, such as to reinforce the blasting of the arc over long arcing times. This increased thermal effect is possible by confining the electric arc cut-off zone. To this effect, the section of the axial passage for cutting the electric arc of the median part of the nozzle is reduced to encourage the increase in pressure of the cut-off gas in the blasting chamber and increase the blasting pressure of this cut-off gas in this axial passage for cutting the arc.

The drawback of this second solution resides in the fact that strong erosion of the material constituting the nozzle, classically made up of PTFE, is observed for high arc energies during the short-circuiting. If the choice of the PTFE contributes to the increase in pressure of the blasting chamber by degassing and injection of ablated vapors, made up mainly of $C_2F_4$ and $MoS_2$, with the action of intense radiation of the electric arc, nevertheless, the section of the axial passage for cutting the median part of the nozzle increases sharply with wear and tear, therefore allocating the cut-off capacity of the circuit-breaker after multiple cut-offs.

BRIEF DESCRIPTION

The purpose of the invention is thus to propose a new electric arc-blasting nozzle, which addresses the drawbacks of the electric arc-blasting nozzles of prior art.

In particular, this new nozzle must allow for equipping a circuit breaker working with any type of cut-off gas, in particular, and for obvious environmental reasons, with cut-off gases having a lower global warning potential than that of $SF_6$ and, in particular, with $CO_2$ alone or with a gaseous mix comprising of $CO_2$ as the vector gas.

This new nozzle must also make it possible to equip such a circuit breaker without any significant increase in its congestion and in the absence of any notable addition, while ensuring excellent cut-off performances of the electric arc, with such performances also falling in line with the duration.

These purposes mentioned above as well as others are achieved, firstly, with an electric arc-blast nozzle for the aforementioned type of circuit breaker, i.e. with a nozzle comprising:

i. a median neck-forming part internally defining an axial electric arc cut-off passage and formed by a dielectric material obtained from a composition consisting of a fluorocarbon polymer matrix, and ii. two end parts extending on either side of the median part which are respectively intended to receive the arc contacts that can be axially moved in relation to each other, between a circuit breaker opening position in which the arc contacts are separated from each other and a circuit breaker closing position in which the arc contacts are in contact with each other and in which one of the arc contacts partially closes the axial passage of the median part, an electric arc cut-off gas circulating in the axial passage of the median part to cut an electric arc that is likely to be formed during the movement of the arc contacts from the closing position to the opening position of the circuit breaker.

According to the invention, the nozzle comprises an insert defining a downstream area of the axial passage of the median part when considering the direction of the flow of the electric arc cut-off gas, and the insert is formed by another dielectric material, separate from the first material and chosen from among:

i. a composite material obtained from a second composition comprising a fluorocarbon polymer matrix and:

ii. at least one inorganic filler A chosen from among a sulfur, a ceramic and an oxide chosen from among $SiO_2$, $TiO_2$, $Al_2CoO_4$, ZnO, $BaTiO_3$ and $P_2O_5$, in a percentage weight ranging between 0.1% and 10%, with respect to the total weight of the second composition, and/or at least one inorganic filler B chosen from among a graphite, a mica, a glass and a fluoride, $CaF_2$, in a percentage weight ranging between 5% and 50%, with respect to the total weight of the second composition, and i. a ceramic material obtained from a third composition comprising at least one compound chosen from among a carbide, a boride and an oxide.

The presence of an insert formed by the second dielectric material as described above and located in a downstream area of the axial passage of the median part of the nozzle makes it possible to give the nozzle a resistance to thermal erosion observed in the nozzles classically made of PTFE, by keeping the section of this axial passage invariable at the level of the downstream area of said insert and this, irrespective of the wear and tear of the first dielectric material, the number of cut-offs and/or the intensity of the short-circuit.

As described above, in a first embodiment of the nozzle according to the invention, the second dielectric material that forms the insert can be a composite material obtained from a second composition comprising a fluorocarbon polymer matrix and at least one inorganic filler, with this or these inorganic filler(s) being selected both, from the point of view of their nature and their percentage weight with respect to the total weight of the second composition.

As part of this invention, the term "matrix" means that the fluorocarbon polymer constitutes the compound with the predominant percentage weight in the composition in question. This percentage weight is favorably at least 50% and at least 75% in some examples.

In this first embodiment, the fluorocarbon polymer of the second composition can be favorably chosen from among polytetrafluoroethylene (PTFE), a copolymer of ethylene and tetrafluoroethylene (ETFE), a polyfluoride of vinylidene (PVDF).

This fluorocarbon polymer may be polytetrafluoroethylene (PTFE).

According to an initial version, the second composition comprises a fluorocarbon polymer matrix and at least one inorganic filler A chosen from among a sulfur, a ceramic and an oxide chosen from among $SiO_2$, $TiO_2$, $Al_2CoO_4$, ZnO, $BaTiO_3$ and $P_2O_5$, with the percentage weight of this or these filler(s) then ranging between 0.1% and 10%, with respect to the total weight of the second composition.

In a favorable variant of this initial version, the percentage weight of the inorganic filler(s) A ranges between 0.2% and 5% and, in some examples, between 0.5% and 3%, with respect to the total weight of the second composition.

When the inorganic filler A is a sulfur, it may be chosen from among $MoS_2$, $Sb_2S_5$ and $Sb_2S_3$.

When the inorganic filler A is an oxide, it may be chosen from among $SiO_2$, $TiO_2$, $Al_2CoO_4$, ZnO, $BaTiO_3$ and $P_2O_5$ and is, in some examples, $SiO_2$.

When the inorganic filler A is a ceramic, it may be chosen from among boron nitride BN and a $Bi_2O_3$—ZnO—$Nb_2O_3$ mix and is, in some examples, boron nitride BN.

In a favorable variant, the inorganic filler A is chosen from among $MoS_2$, $Sb_2S_5$, $Sb_2S_3$, BN, $SiO_2$, $TiO_2$, $Al_2CoO_4$, ZnO, $BaTiO_3$, $P_2O_5$ and $Bi_2O_3$—ZnO—$Nb_2O_3$.

In a more specific variant, the inorganic filler A is chosen from among $SiO_2$ and BN. In effect, both these inorganic fillers give the insert, and therefore the nozzle, resistance to the intense radiation of the particularly powerful electric arc.

In an even more particular variant, when the inorganic filler A is $SiO_2$, this filler charge appears in the form of particles having a granulometry less than or equal to 10 μm and in some examples, ranges between 0.5 μm and 5 μm.

According to a second version, the second composition comprises a fluorocarbon polymer matrix and at least one inorganic filler B chosen from among a graphite, a mica, a glass and a fluoride, with the percentage weight of this or these inorganic filler(s) B then ranging between 5% and 50%, with respect to the total weight of the second composition.

In a favorable variant of this second version, the percentage weight of the inorganic filler(s) B ranges between 10% and 30% and in some examples, between 15% and 25%, with respect to the total weight of the second composition.

When the inorganic filler B is a fluoride, it is in some examples, $CaF_2$.

In a favorable variant of this second version, the inorganic filler B is $CaF_2$.

The second composition, which makes it possible to obtain this second dielectric material, may comprise only one inorganic filler A or B.

But, whether it is in its first or second version, the second composition can also comprise a mix of two, three or even more inorganic fillers A and/or B, it being specified that these mixes may only comprise inorganic fillers A or B. But these mixes may also comprise one or more inorganic fillers A and one or more inorganic fillers B.

In a favorable variant of the invention, the second composition does not comprise of any inorganic filler B, i.e. the second only comprises one or more inorganic fillers A, in some examples, a single inorganic filler A. In this latest variant, the inorganic filler A is favorably chosen from among $SiO_2$ and BN.

According to a specific embodiment of the invention, the insert is made up of a composite material which comprises a same percentage weight of inorganic filler(s) A and/or B in the fluorocarbon polymer matrix.

According to another specific embodiment of the invention, the insert is made up of a composite material which has a gradient of percentage weights of inorganic filler(s) A and/or B in the fluorocarbon polymer matrix, which increases in the direction of the flow of the electric arc cut-off gas.

In a second embodiment of the nozzle according to the invention, the second dielectric material that forms the insert can be a ceramic material obtained from a third composition comprising at least one compound chosen from among a carbide, a boride and an oxide.

The third composition that makes it possible to obtain this ceramic material may comprise only a single compound, but it may also comprise a mix of two, three, or even more compounds.

When this compound is a carbide, this carbide may particularly be chosen from among a silicon carbide SiC, a zirconium carbide ZrC and a hafnium carbide HfC.

When this compound is a boride, this boride may particularly be chosen from among a zirconium diboride $ZrB_2$ and a hafnium diboride $HfB_2$.

When this compound is an oxide, this oxide may particularly be chosen from among silicon dioxide, or silica, $SiO_2$ and zirconium dioxide $ZrO_2$.

According to a specific embodiment of the invention, the compound of the third composition is chosen from among SiC, ZrC, HfC, $ZrB_2$, $HfB_2$, $SiO_2$ and $ZrO_2$.

The third composition may only consist of a single compound. For example, the ceramic material can be formed only from silica $SiO_2$, silicon carbide SiC or zirconium dioxide $ZrO_2$, which are all high temperature-resistant compounds.

The third composition may also consist of a mix of two, three or even more of these single compounds.

Conversely, in addition to this/these carbide, boride and oxide type compounds that have just been mentioned, the third composition which makes it possible to obtain this ceramic material may also comprise at least one inorganic filler.

This third composition may not only comprise one single inorganic filler, but also a mix of two, three or even more of inorganic fillers.

A more particular inorganic filler is SiC, if the compound itself is not SiC.

That the second dielectric material of the insert is a composite material according to the first embodiment or ceramic material according to the second embodiment, the first dielectric material of the median part of the nozzle is obtained from a first composition comprising a fluorocarbon polymer matrix, which has good mechanical properties and thermal resistance.

Like the fluorocarbon polymer of the second composition, the fluorocarbon of the first composition can be favorably chosen from among polytetrafluoroethylene (PTFE), a copolymer of ethylene and tetrafluoroethylene (ETFE), a polyfluoride of vinylidene (PVDF) and is in some examples, polytetrafluoroethylene.

The first composition from which the first dielectric material is obtained may be made up only of one or more fluorocarbon polymers and, therefore, not comprise any inorganic filler.

But this first composition may also comprise at least one inorganic filler C in a percentage weight, with respect to the total weight of the first composition, less than or equal to 10%, unless the inorganic filler C is chosen from among the inorganic fillers A and/or B, in which case the percentage weight of the inorganic filler(s) C is strictly less than the percentage weight of the inorganic filler(s) A and/or B of the second composition.

According to a specific embodiment of the invention, the percentage weight of the inorganic filler(s) C in the first composition ranges between 0.01% and 5% and in some examples, between 0.1% and 2%, with respect to the total weight of the first composition.

The inorganic filler C of the first composition may be chosen from among a fluoride such as $CaF_2$, a sulfide such as $MoS_2$, $Sb_2S_5$ or $Sb_2S_3$, an oxide such as $SiO_2$, $TiO_2$, $Al_2O_3$, $Al_2CoO_4$, ZnO, $BaTiO_3$ or $P_2O_5$, a graphite, a mica, a glass and a ceramic such as boron nitride BN or a $Bi_2O_3$—ZnO—$Nb_2O_3$ mix.

In a favorable variant of the invention, the inorganic filler C of the first composition may be chosen from among the same inorganic fillers A and/or B mentioned above for the second composition.

In a variant of the invention, the inorganic filler C of the first composition is chosen from among $MoS_2$ and $Al_2CoO_4$.

As indicated above for the first dielectric material of the median part of the nozzle, that the second dielectric material of the insert is a composite material according to the first embodiment or a ceramic material according to the second embodiment, both the end parts of the nozzle can be made up of a dielectric material, which also has good mechanical properties and thermal resistance.

In a specific embodiment of the invention, the two end parts of the nozzle are made up of a dielectric material also obtained from a fourth composition comprising a fluorocarbon polymer matrix and, where required, at least one inorganic filler.

For fluorocarbon polymers, inorganic fillers and their percentage weights suitable for this fourth composition, one may refer to what has been described above in regard to fluorocarbon polymers and inorganic fillers suitable for the first composition, which make it possible to obtain the first dielectric material of the median part of the nozzle.

In a favorable embodiment of the invention, the two end parts of the nozzle are formed with the first dielectric material of this median part of the nozzle.

In this favorable embodiment, it would be possible to manufacture, in a single piece, the entire unit formed with the two end parts and the median part for its part formed with the first dielectric material, excluding the insert.

In another embodiment, the nozzle according to the invention may also comprise a sheath disposed on the external surface of each of the two end parts and on that of the neck-forming median part.

Such a sheath can particularly make it possible to ensure the connection between the mobile parts of a circuit breaker equipped with a nozzle according to the invention.

Such a sheath can, for example, be installed by machining, molding or even by overmolding on the end parts and on the medial part, which form the nozzle.

This sheath is favorably made from a dielectric material, which also has good mechanical properties and thermal resistance. The material described for the two end parts as well as the first dielectric material of the median part of the nozzle are suitable as material constituting such a sheath.

This dielectric material of the sheath may thus comprise a fluorocarbon polymer such as polytetrafluoroethylene (PTFE), a copolymer of ethylene and tetrafluoroethylene (ETFE) or a polyfluoride of vinylidene (PVDF) and, where appropriate, one or more inorganic fillers.

The dielectric material of the sheath may also comprise another polymer, for example polyether ether ketone (PEEK), polysulfone (PSU), polyphenylsulfone (PPSU), polyimide (PI) or even polyetherimide (PEI).

In an embodiment, the thickness of the sheath may represent up to 150% of the radius of the nozzle as measured from the median part. This thickness of the sheath favorably ranges between 50% and 100% and, in some examples, between 70% and 80%, of the radius of the nozzle as measured from the median part.

According to a specific embodiment of the invention, the length of the insert, which is present in the median part of the nozzle, represents maximum 30% of the total length of the median part. In effect, this percentage makes it possible to effectively and simultaneously keep the section of the axial passage of the nozzle constant, in its downstream area, as well as the increase in pressure of the blasting chamber by degassing and injection of ablated vapors, made up mainly of $C_2F_4$ and $MoS_2$, subject to the action of intense radiation of the electric arc, outside the downstream area defined by the insert.

In a favorable variant, this length of the insert in the median part of the nozzle represents between 1% and 15% and in some examples, between 5% and 10% of the total length of the median part.

According to a specific embodiment of the invention, the insert forms a section of the median part.

According to a specific embodiment of the invention, the insert extends up to the downstream end of the median part.

According to a specific embodiment of the invention, the insert extends beyond the downstream end of the median part in at least one area of the internal peripheral surface of the downstream end part, throughout this internal peripheral surface of the downstream end part, considering the direction of the flow of the electric arc cut-off gas.

In this last assumption, and assuming that the second dielectric material of the insert is a composite material according to the first embodiment or a ceramic material according to the second embodiment, the upstream end part and, where required, at least a portion of the downstream end part, are formed with the first dielectric material, the upstream and downstream disposition of the end parts being considered in the direction of the flow of the electric arc cut-off gas.

In a favorable variant, this internal peripheral surface of the downstream end part considering the direction of the flow of the electric arc cut-off gas is in the shape of a truncated cone. Such a truncated cone shape particularly has the advantage of optimizing the flow of the cut-off gas.

Secondly, the invention relates to a circuit breaker, and a high voltage circuit breaker comprising:

i. at least two arc contacts axially mobile in relation to each other, between a circuit breaker opening position in which the arc contacts are separated from each other and a circuit breaker closing position in which the arc contacts are in contact with each other, ii. an electric arc-blast nozzle, and iii. an electric arc cut-off gas circulating in the axial passage of the median part of the nozzle to cut an electric arc that is likely to be formed during the movement of the arc contacts from the closing position to the opening position of the circuit breaker.

According to the invention, the electric arc-blast nozzle of such a circuit breaker is such as defined above, i.e. this nozzle comprises an insert defining a downstream area of the axial passage of the median part considering the direction of the flow of the electric arc cut-off gas, with the insert being formed by a second dielectric material, separate from the first dielectric material and chosen from among:

i. a composite material obtained from a second composition comprising a fluorocarbon polymer matrix and:

ii. at least one inorganic filler A chosen from among a sulfur, a ceramic and an oxide chosen from among $SiO_2$, $TiO_2$, $Al_2CoO_4$, ZnO, $BaTiO_3$ and $P_2O_5$, in a percentage weight ranging between 0.1% and 10%, with respect to the total weight of the second composition, and/or iii. at least one inorganic filler B chosen from among a graphite, a mica, a glass and a fluoride, in some examples, $CaF_2$, in a percentage weight ranging between 5% and 50%, with respect to the total weight of the second composition, and iv. a ceramic material obtained from a third composition comprising at least one compound chosen from among a carbide, a boride and an oxide.

The favorable characteristics described above for the electric arc-blast nozzle according to the invention can evidently be taken by themselves or in combination in relation with the circuit breaker according to the invention.

The presence of the insert in the electric arc-blast nozzle makes it possible to obtain a notable improvement in the electrical endurance of a circuit breaker according to the invention.

According to an embodiment of the invention, the electric arc cut-off gas implemented in the circuit breaker according to the invention consists of carbon dioxide $CO_2$ or is a gaseous mix comprising mainly $CO_2$. In particular, this gaseous mix can be constituted with the cut-off gas marketed by Alstom under the name $g^3$ (or "green gas for grid").

According to another embodiment of the invention, the electric arc cut-off gas implemented in the circuit breaker according to the invention can also be a conventional cut-off gas, such as sulfur hexafluoride $SF_6$.

Other advantages and characteristics of the invention will appear upon reading the detailed description that follows and that relates to two electric arc-blast nozzle structures, one complying with the prior art and the other complying with the invention, as well as the various possible compliances for the insert of an electric arc-blast nozzle according to the invention.

This detailed description, which refers mainly to FIGS. 1 to 7 as appended, is given for illustration and does not, in any case, constitute a limitation of the purpose of the invention.

It is specified that the common elements in FIGS. 1 to 7 are marked with the same numerical reference.

DETAILED DESCRIPTION

Figure 1:
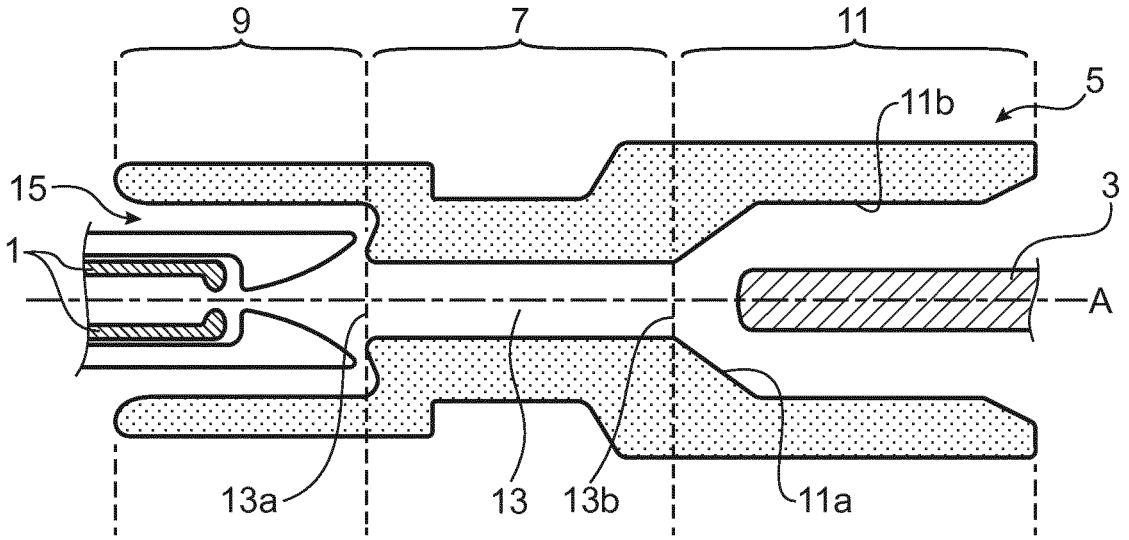
FIG. 1 shows a partial schematic longitudinal section of a circuit breaker comprising an electric art blast nozzle according to the prior art.

FIG. 1 shows a part of the circuit breaker. This circuit breaker comprises:

i. at least two arc contacts 1 and 3 axially mobile in relation to each other, along an axis A, between a circuit breaker opening position in which the arc contacts 1 and 3 are separated from each other and a circuit breaker closing position in which the arc contacts 1 and 3 are in contact with each other, and ii. an electric arc-blast nozzle 5 conforming to prior art.

This nozzle 5 comprises a neck-forming median part 7, an end part 9 disposed upstream and an end part 11 disposed downstream, the upstream and downstream disposition of the end parts 9 and 11 being considered in the direction of the flow of the electric arc cut-off gas. These two end parts 9 and 11 extend on either side of the median part 7. These parts 7, 9 and 11 have a symmetrical revolution around axis A.

The median part 7 internally defines an axial passage 13 of the electric arc cut-off, this axial passage 13 comprising an inlet 13*a* and an outlet 13*b*. This median part 7 is called the neck-forming median part 7, due to the internal section of this axial passage 13, which is smaller than the internal section of each of the end parts 9 and 11.

The end parts 9 and 11 respectively receive and surround the arc contacts 1 and 3.

The median part 9 disposed upstream channels the cut-off gas situated upstream and intended to blast the electric arc, whereas the median part 11 disposed downstream evacuates and circulates the blast gas situated downstream, upstream and downstream being defined with reference to the direction of the flow of the electric arc cut-off gas.

The end part 9 may have a cover 10, with this cover 10 surrounding arc contact 1.

In FIG. 1, the arc contacts 1 and 3 are separated from each other and therefore correspond to the opening position of the circuit breaker.

When the arc contacts 1 and 3 are in contact with each other, in the closing position of the circuit breaker, the arc contact 3 closes the axial passage 13 of the median part 7 partially.

There is an electric arc cut-off gas routing channel 15 between the arc contact 1 and the wall of the end part 9, which allows the circulation of this gas in the axial passage 13 of the median part 7, from its inlet 13*a* to its outlet 13*b*, to cut an electric arc that is likely to be formed during the movement of arc contacts 1 and 3 from the closing position to the opening position of the circuit breaker.

The end part 11 has a truncated cone shaped part 11*a* disposed in the extension of the median part 7 situated with respect to the outlet 13*b* of the axial passage 13, this truncated cone shaped part 11*a* being followed by a cylindrical part 11*b*.

The neck-forming median part 7 as well as the cover 10 and the end parts 9 and 11 are made from a first dielectric material, which has good mechanical properties and thermal resistance. Typically, this first dielectric material is obtained from a first composition comprising a fluorocarbon polymer matrix, classically a PTFE matrix.

This first composition may comprise one or more inorganic fillers C. When they are present, the inorganic fillers classically represent a percentage weight that may go up to 10% of the total weight of the first composition, this percentage weight ranging more generally between 0.01% and 5% with respect to the total weight of the first composition.

Figure 2:
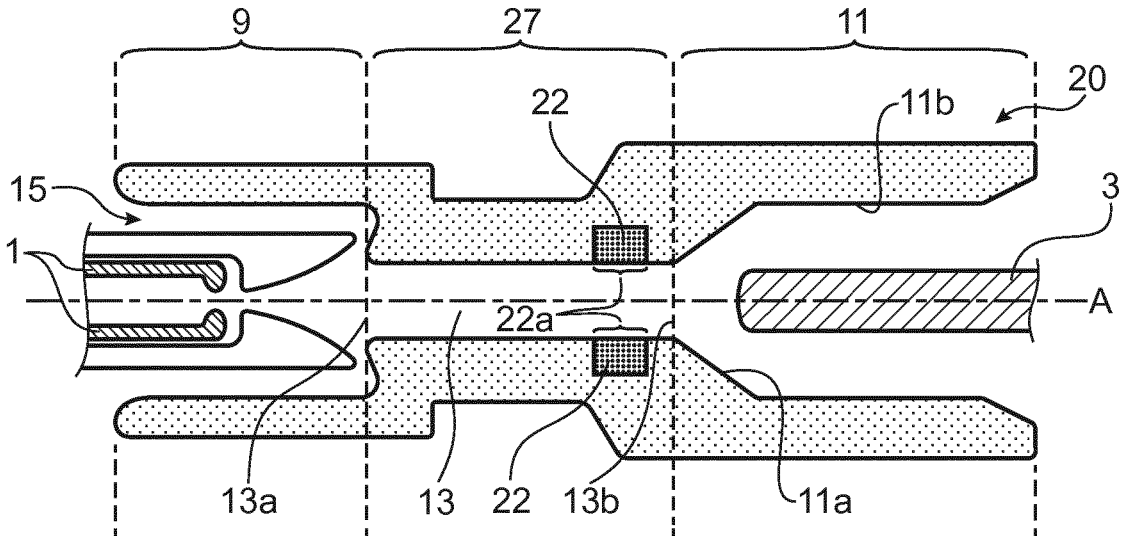
FIG. 2 shows a partial schematic longitudinal section of a circuit breaker comprising an electric art blast nozzle according to the invention, the nozzle being equipped with an insert according to the first conformation.

Like FIG. 1, FIG. 2 represents part of the circuit breaker that comprises at least two arc contacts 1 and 3 that are axially movable with respect to each other, between an opening position and a closing position, as well as an electric arc-blast nozzle 20 that complies with the invention.

Like nozzle 5 from FIG. 1, the nozzle 20 according to the invention represented in FIG. 2 comprises a neck-forming median part 27 and two end parts 9 and 11 extending on either side of the median part 27. This neck-forming median part 27 internally defines an electric arc cut-off axial passage 13 equipped with an inlet 13*a* and an outlet 13*b*.

Unlike the nozzle 5 from FIG. 1, nozzle 20 from FIG. 2 comprises an insert 22 defining a downstream area 22*a* of the axial passage 13 of the median part 27 considering the direction of the flow of the cut-off gas, direction that is established at the inlet 13*a* towards the outlet 13*b* of the axial passage 13.

In FIG. 2, the insert 22 is in the form of a ring. However, nothing prohibits from giving this insert a more complex form.

The insert 22 of the nozzle 20 according to the invention is formed with a second dielectric material, separate from the first dielectric material forming the median part 27 (insert 22 not included) and the end parts 9 and 11.

This second dielectric material, which gives the insert 22 excellent resistance to radiation from the electric arc, is chosen from:

i. a composite material obtained from a second composition comprising a fluorocarbon polymer matrix and:

ii. at least one inorganic filler A chosen from among a sulfur, a ceramic and an oxide chosen from among $SiO_2$, $TiO_2$, $Al_2CoO_4$, ZnO, $BaTiO_3$ and $P_2O_5$, in a percentage weight ranging between 0.1% and 10%, with respect to the total weight of the second composition, and/or iii. at least one inorganic filler B chosen from among a graphite, a mica, a glass and a fluoride, in some examples, $CaF_2$, in a percentage weight ranging between 5% and 50%, with respect to the total weight of the second composition, and iv. a ceramic material obtained from a third composition comprising at least one compound chosen from among a carbide, a boride and an oxide.

Reference should be made to the chapter on the disclosure of the invention for any specification concerning the different variants of the second and third compositions that are likely to be possible for obtaining these composite and ceramic materials constituting the second dielectric material suitable for the insert 22.

As represented in FIG. 2, the length of the insert 22, considered along the A axis, represents less than 30% of the total length of the median part 27.

The nozzle 20 can be manufactured using any classic procedure, for example, by overmolding the median part 27 and end parts 9 and 11 on the insert 22.

Figure 3:
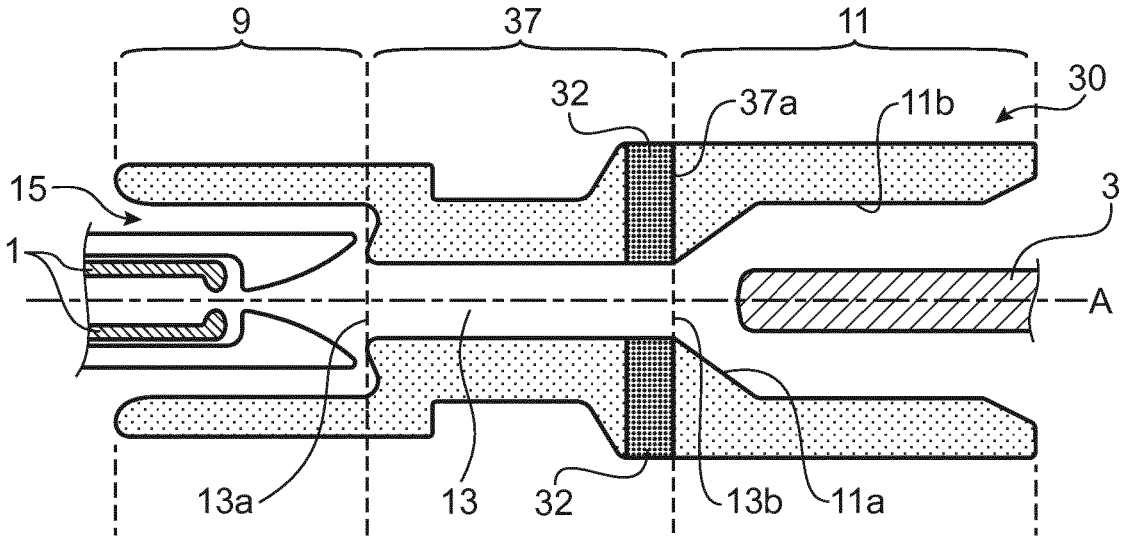
FIG. 3 shows a partial schematic longitudinal section of a circuit breaker comprising an electric art blast nozzle according to the invention, the nozzle being equipped with an insert according to the second conformation.

FIG. 3 shows a nozzle 30 according to the invention in which the median part 37 comprises an insert 32 appearing in another conformation.

More precisely, the insert 32 constitutes a section of this median part 37, which extends transversally from the internal surface of the axial passage 13 to the external surface of the median part 37.

In this representation of FIG. 3, the insert 32 also extends longitudinally up to the downstream end 37*a* of the median part 37.

Figure 4:
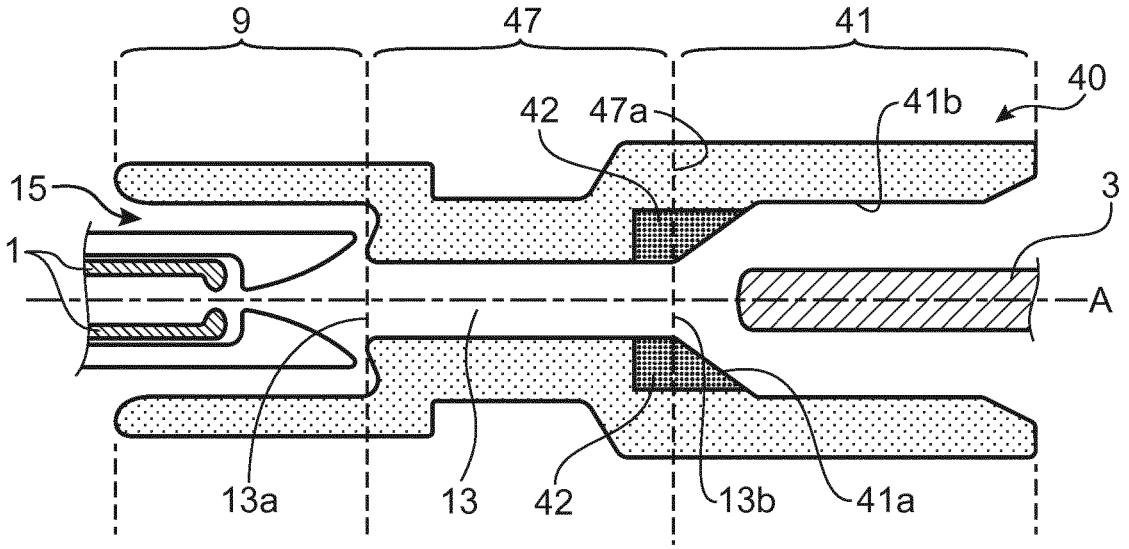
FIG. 4 shows a partial schematic longitudinal section of a circuit breaker comprising an electric art blast nozzle according to the invention, the nozzle being equipped with an insert according to the third conformation.

FIG. 4 shows a nozzle 40 according to the invention in which the median part 47 comprises an insert 42 appearing in another conformation.

The insert 42 represented in FIG. 4 extends longitudinally beyond the downstream end 47*a* of the median part 47 in a portion of the part shaped like a truncated cone 41*a* of the end part 41. Doing so, the insert 42 is located in at least one internal peripheral surface area of this part shaped like a truncated cone 41*a*, which makes it possible to optimize the flow of the cut-off gas.

Figure 5:
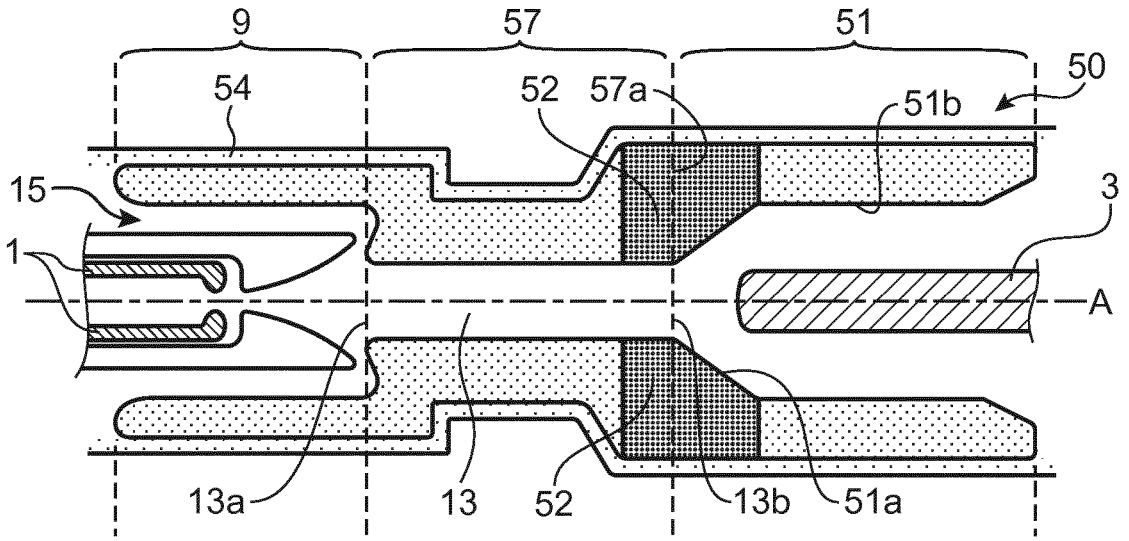
FIG. 5 shows a partial schematic longitudinal section of a circuit breaker comprising an electric art blast nozzle according to the invention, the nozzle being equipped with an insert according to fourth conformation and a sheath.

FIG. 5 shows a nozzle 50 according to the invention in which the median part 57 comprises an insert 52 appearing in another conformation.

Like the insert 42 of FIG. 4, the insert 52 of FIG. 5 extends longitudinally beyond the downstream end 57*a* of the median part 57 up to the part shaped like a truncated cone 51*a* of the end part 51.

The insert 52 also extends transversally from the internal surface of the axial passage 13 up to the external surface of the median part 57 and the internal surface up to the external surface of the part shaped like a truncated cone 51*a*.

The nozzle 50 also comprises a sheath 54 disposed on the external surface of each of the two end parts 9 and 51 and the neck-forming median part 57.

Figure 6:
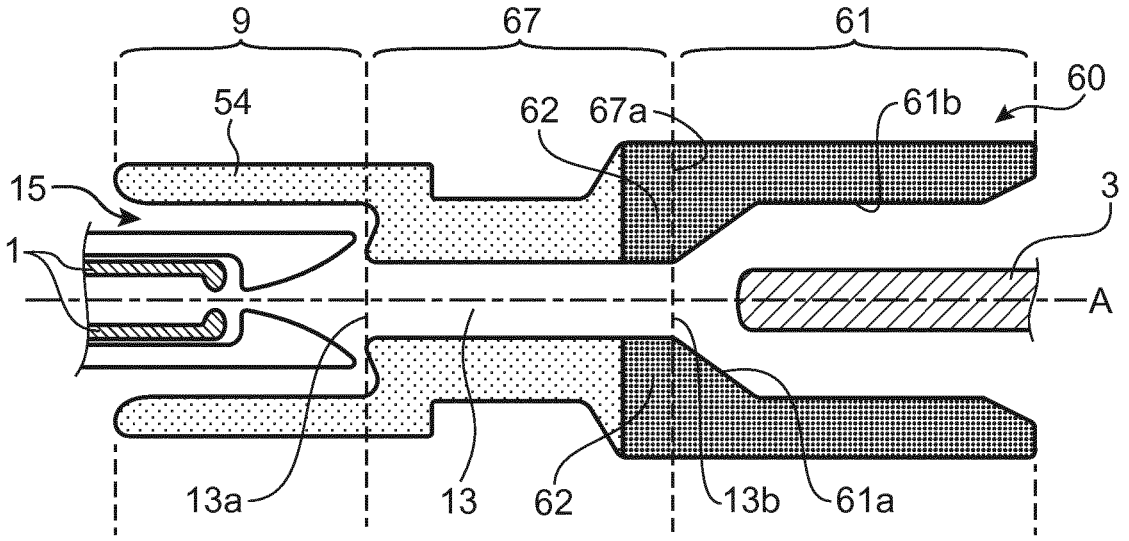
FIG. 6 shows a partial schematic longitudinal section of a circuit breaker comprising an electric art blast nozzle according to the invention, the nozzle being equipped with an insert according to the fifth conformation.

FIG. 6 shows a nozzle 60 according to the invention in which the median part 67 comprises an insert 62 appearing in another conformation.

As in the case of insert 52 represented in FIG. 5, the insert 62 of FIG. 6 extends longitudinally beyond the downstream end 67*a* of the median part 67 and this, throughout the length of the end part 61.

The insert 62 also extends transversally from the internal surface of the axial passage 13 up to the external surface of the median part 67 but also the internal surfaces of the parts shaped like a truncated cone 61*a* and end 61*b* up to the external surface of the end part 61.

In other words, according to this fifth conformation of the nozzle 60, the insert 62 comprises the end part 61.

Figure 7:
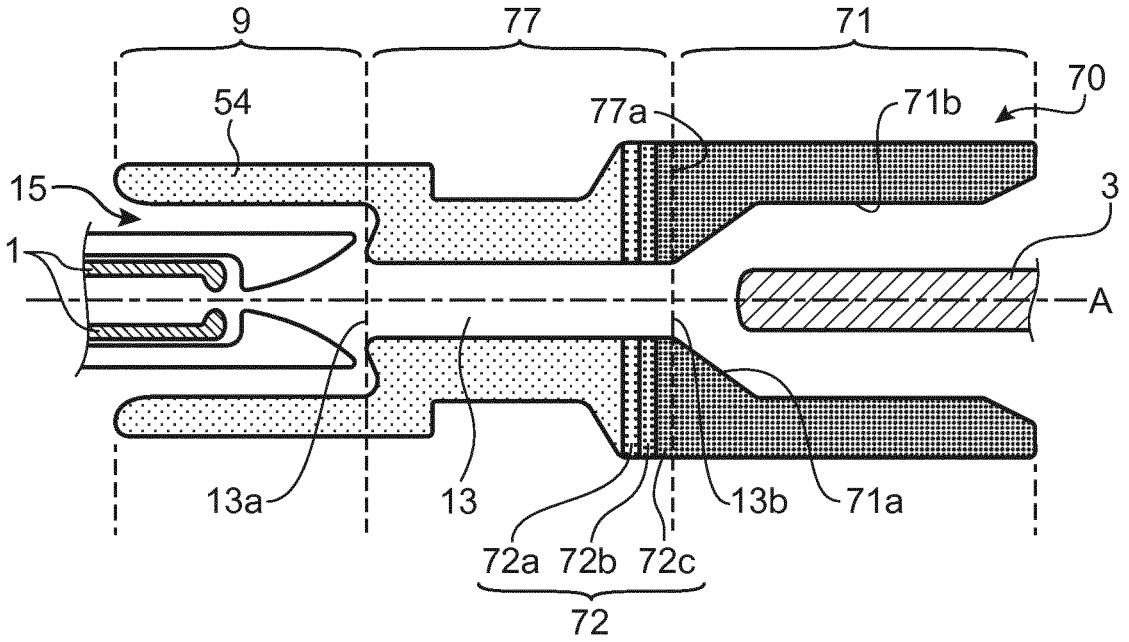
FIG. 7 shows a partial schematic longitudinal section of a circuit breaker comprising an electric art blast nozzle according to the invention, the nozzle being equipped with an insert according to the sixth conformation.

FIG. 7 shows a nozzle 70 according to the invention in which the median part 77 comprises an insert 72 appearing in another conformation.

This insert 72 extends longitudinally beyond the downstream end 77*a* of the median part 77 and this, throughout the length of the end part 71.

The insert 72 extends transversally from the internal surface of the axial passage 13 up to the external surface of the median part 77 but also the internal surfaces of the parts shaped like a truncated cone 71*a* and end 71*b* up to the external surface of the end part 71.

As shown in FIG. 7, the insert 72 is made up of three portions 72*a*, 72*b* and 72*c*. All these three portions 72*a*, 72*b* and 72*c* are formed with a second dielectric material from two compositions comprising a fluorocarbon polymer matrix and at least one inorganic filler chosen from an inorganic filler A and an inorganic filler B, with this second dielectric material having a gradient of percentage weights of inorganic filler(s) in the fluorocarbon polymer matrix, which increases considering the direction of the flow of the electric arc cut-off gas.

In other words, the percentage weights of inorganic filler(s) A and/or B in the second composition of the portion 72*a* is less than the portion 72*b*, which itself being less than the portion 72*c*, these various percentage weights evidently remain within the intervals of the percentage weight defined above based on the nature of the inorganic filler(s) A and/or B in question.

In a particularly more favorable manner, the fluorocarbon polymer(s) as well as the inorganic fillers A and/or B used in the second compositions from which the portions 72*a*, 72*b* and 72*c* of the insert 72 are obtained are identical.

The electric arc-blast nozzles according to the invention, such as nozzles 20, 30, 40, 50, 60 and 70 respectively shown in FIGS. 2 to 7, can be completely transposed in the conventional nozzle structures. In other words, the median parts 27, 37, 47, 57, 67 and 77 and, where applicable, the end parts 41, 51, 61 and 71 can respectively replace the median part 7 and, where applicable, the end part 11 of the nozzle 5 shown in FIG. 1, without any change in the dimensions of the various parts constituting these nozzles.

However, nothing stops the neck-forming median part from being extended in the longitudinal direction by a length that may go up to reaching the length of the insert in said median part. In such circumstances, the path of the arc contacts 1 and 3 may be proportionally increased.

We claim:

1. An electric arc-blast nozzle for a circuit breaker comprising:

a neck-forming median part internally defining an axial passage for cutting an electric arc and formed with a first dielectric material obtained from a first composition comprising a fluorocarbon polymer matrix, two end parts extending on either side of the median part which are respectively intended to receive arc contacts that can be axially moved in relation to each other, between a circuit breaker opening position in which the arc contacts are separated from each other and a circuit breaker closing position in which the arc contacts are in contact with each other and in which one of the arc contacts partially closes the axial passage of the median part, an electric arc cut-off gas circulating in the axial passage of the median part to cut the electric arc that is likely to be formed during movement of the arc contacts from the closing position to the opening position of the circuit breaker, and an insert, that defines a downstream area of the axial passage of the median part considering a direction of a flow of the electric arc cut-off gas and is, also, formed with a second dielectric material, different from the first dielectric material and from among:

a composite material obtained from a second composition comprising a fluorocarbon polymer matrix and:

at least one inorganic filler A comprising at least one of MoS2, Sb2Ss or Sb2S3, a ceramic, BN, and an oxide comprising at least one of Si02, Ti02, AhCoQ4, ZnO, BaTiQ3 and P205, in a percentage weight ranging between 0.1% and 10%, with respect to a total weight of the second composition, and/or at least one inorganic filler B comprising at least one of a graphite, a mica, a glass and a fluoride, in a percentage weight ranging between 5% and 50%, with respect to the total weight of the second composition, and a ceramic material obtained from a third composition comprising at least one compound comprising at least one of a carbide, a boride and an oxide.

2. The nozzle according to claim 1, wherein the inorganic filler A is chosen from BN and Si02.

3. The nozzle according to claim 1, wherein the percentage weight of the inorganic filler(s) A ranges between 0.2% and 5%, with respect to the total weight of the second composition.

4. The nozzle according to claim 1, wherein the percentage weight of the inorganic filler(s) B ranges between 10% and 30%, with respect to the total weight of the second composition.

5. The nozzle according to claim 1, wherein the composite material has a gradient of percentage weights of inorganic filler(s) A and/or B in the fluorocarbon polymer matrix which increases in the direction of the flow of the electric arc cut-off gas.

6. The nozzle according to claim 1, wherein the second composition comprises only one inorganic filler A.

7. The nozzle according to claim 1, wherein the compound of the third composition comprising at least one of SiC, ZrC, HfC, ZrB2, HfB2, SiO2, and ZrO2.

8. The nozzle according to claim 1, wherein the third composition also comprises at least one inorganic filler.

9. The nozzle according to claim 1, wherein the first composition further comprises at least one inorganic filler C in percentage weight, with respect to the total weight of the first composition, of less than or equal to 10%, except where the inorganic filler C comprising inorganic fillers A and/or B, in which case the percentage weight of the inorganic fillers C is less than the percentage weight of the inorganic filler(s) A and/or B of the second composition.

10. The nozzle according to claim 9, wherein the inorganic filler C comprising at least one of MoS2 and AhCo04.

11. The nozzle according to claim 1, wherein the first composition does not comprise the inorganic filler.

12. The nozzle according to claim 1, wherein the fluorocarbon polymer of the first and second compositions is chosen from polytetrafluoroethylene, a copolymer of ethylene and tetrafluoroethylene and, a polyfluoride of vinylidene.

13. The nozzle according to claim 1, wherein a length of the insert present in the median part represents no more than 30%.

14. The nozzle according to claim 1, wherein the insert forms a section of the median part.

15. The nozzle according to claim 1, wherein the insert extends up to a downstream end of the median part.

16. The nozzle according to claim 15, wherein the insert extends beyond the downstream end of the median part in at least one area of an internal peripheral surface of the end part disposed downstream considering the direction of the flow of the electric arc cut-off gas, the internal peripheral surface being in a shape of a truncated cone.

17. The nozzle according to claim 1, wherein the end part disposed upstream and, where required, at least a portion of the end part disposed downstream are formed with the first dielectric material, the upstream and downstream disposition of the end parts considering the direction of the flow of the electric arc cut-off gas.

18. The nozzle according to claim 1, further comprising a sheath disposed on an external surface of each of the two end parts and the neck-forming median part.

19. A high voltage circuit breaker comprising:

at least two arc contacts and that can be axially moved in relation to each other, between the circuit breaker opening position in which the arc contacts are separated from each other and the circuit breaker closing position in which the arc contacts are in contact with each other, the electric arc-blast nozzle defined according to claim 1, and the electric arc to cut-off gas circulating in the axial passage of the median part of the nozzle to cut the electric arc that is likely to be formed during the movement of the arc contacts from the circuit breaker closing position to the circuit breaker closing position.

20. A circuit breaker according to claim 19, wherein the electric arc cut-off gas comprising of at least one of carbon dioxide CO2, sulfur hexafluoride SF6 and is a gaseous mix comprising CO2.

* * * * *